US006082542A

United States Patent [19]

McGrath et al.

[11] Patent Number: 6,082,542

[45] Date of Patent: Jul. 4, 2000

[54] FULL-DEPTH NESTABLE CRATE

[76] Inventors: Patrick James McGrath, 6445 Oriole Dr., Dallas, Tex. 75209; Robert C. Allabaugh, Jr., 404 Osceola St., P.O. Box 1419, Minneola, Fla. 34755

[21] Appl. No.: 09/141,889

[22] Filed: Aug. 28, 1998

[51] Int. Cl.[7] ..... B65D 21/02

[52] U.S. Cl. ..... 206/519; 206/427; 206/504; 206/518; 206/564; 220/519

[58] Field of Search ..... 206/515, 518, 206/519, 520, 427, 504; 220/519

[56] References Cited

U.S. PATENT DOCUMENTS

| | | | |
|---|---|---|---|
| 4,096,947 | 6/1978 | Morse | 206/518 |
| 4,256,224 | 3/1981 | Hirota | 206/518 |
| 5,105,948 | 4/1992 | Morris et al. | 206/519 |
| 5,184,748 | 2/1993 | Apps | 206/518 |
| 5,305,884 | 4/1994 | Apps et al. | 206/519 |
| 5,495,945 | 3/1996 | Apps et al. | 206/519 |

*Primary Examiner*—Joseph M. Moy
*Attorney, Agent, or Firm*—Holland & Knight LLP; Robert L. Wolter, Esq.

[57] ABSTRACT

A full-depth nestable crate includes a plurality of columns, projections and channels disposed along exterior and interior surfaces of a retainer wall such that a top crate is nestable within a bottom crate in a first position and stacked on top of a bottom crate when rotated 180° to a second position with respect to the bottom crate. A plurality of stacking rings depend from the bottom floor and interlock a top crate with a bottom crate when crates are stacked or nested. Each stacking ring is aligned with a pocket in the crate and disposed over a bottle in a bottom crate. A bottle cap on the bottle seats within a depression formed in the stacking ring.

10 Claims, 10 Drawing Sheets

FULL-DEPTH NESTABLE CRATE

FIELD OF THE INVENTION

This invention relates to plastic reusable crates for storing and transporting beverage bottles. More specifically, this invention relates to such crates that are nestable when empty crates are stacked, and also capable of cross-stacking when the crates are empty or filled with bottles. This invention pertains also to such crates that are full-depth crates.

BACKGROUND

Beverage bottles are stored, transported and sometimes displayed in plastic reusable crates. Manufacturers attempt to implement several features or characteristics to efficiently transport and store both bottle-filled crates and empty crates. Two important features include bottle control within the crate and "nestability" of stacked empty crates.

Low-depth crates are often used to store and transport bottles. These low-depth crates have vertically disposed surfaces along an interior wall, columns or pylons to support bottles within the crate. The low-depth nature of the crates refers to the characteristic height of a crate that is lower than the height of the bottle. The height of the crates may vary, but generally the height of the crate wall is at least a third of the height of bottle. The low-depth nature of these crates allows a greater number of empty crates to be stacked on top of one another. In addition, the crates may provide visibility of labels for taller bottles.

Larger bottles, such as one-liter, two-liter or even three-liter bottles may pose problems for storing bottles in the low-depth crates. The low depth crates may not provide adequate support for the taller bottles when bottle-filled crates are stacked. In addition, the bottles may have a tendency to topple when bottles are removed. A full-depth crate may resolve some of these problems; however, such a full-depth crate should preferably be nestable to stack empty crates.

SUMMARY OF THE INVENTION

In view of the foregoing, it is an object of the present invention to provide a full-depth crate that is nestable when empty crates are stacked atop one another. To that end the crate is preferably nestable up to fifty percent of the height of the crate.

An additional objective of this invention is to provide such a crate that may also be cross-stacked when the crates are stacked empty or filled with bottles. Another object of the invention is to provide such a crate with means, depending from the bottom of the crate for interlocking a top crate stacked or nested on a lower crate of like configuration.

The full-depth crate includes a retainer wall extending upward from a floor. The wall includes two opposing side walls and two opposing end walls. A plurality of arcuate shaped bottle support surfaces extend along a lower portion of the wall forming an undulating interior surface of the crate and a plurality of pockets within which bottles may stand. A plurality of upper support surfaces are disposed along an interior of the crate; each upper support surface is concentrically aligned a respective lower support surface. The upper support surfaces define an upper interior surface of the crate and is displaced toward an exterior of the crate forming a nesting step disposed between the upper and lower support surfaces. Therefore, the lower portion of a top crate is nestable within the upper portion of a bottom crate.

The crate includes a plurality of columns, projections, and channels disposed along the exterior and interior surfaces of the crate such that a top crate is nestable within a bottom crate in a first position and stacked on top of a bottom crate when rotated 180° to a second position with respect to the bottom crate.

A plurality of stacking rings depend from the bottom of the floor and interlock a top crate with a bottom crate when crates are stacked or nested. Each stacking ring is aligned with a pocket in the crate and disposed over a bottle in a bottom crate. A bottle cap on the bottom seats within a depression formed in the stacking ring.

DETAILED DESCRIPTION OF THE INVENTION

Figure 1:
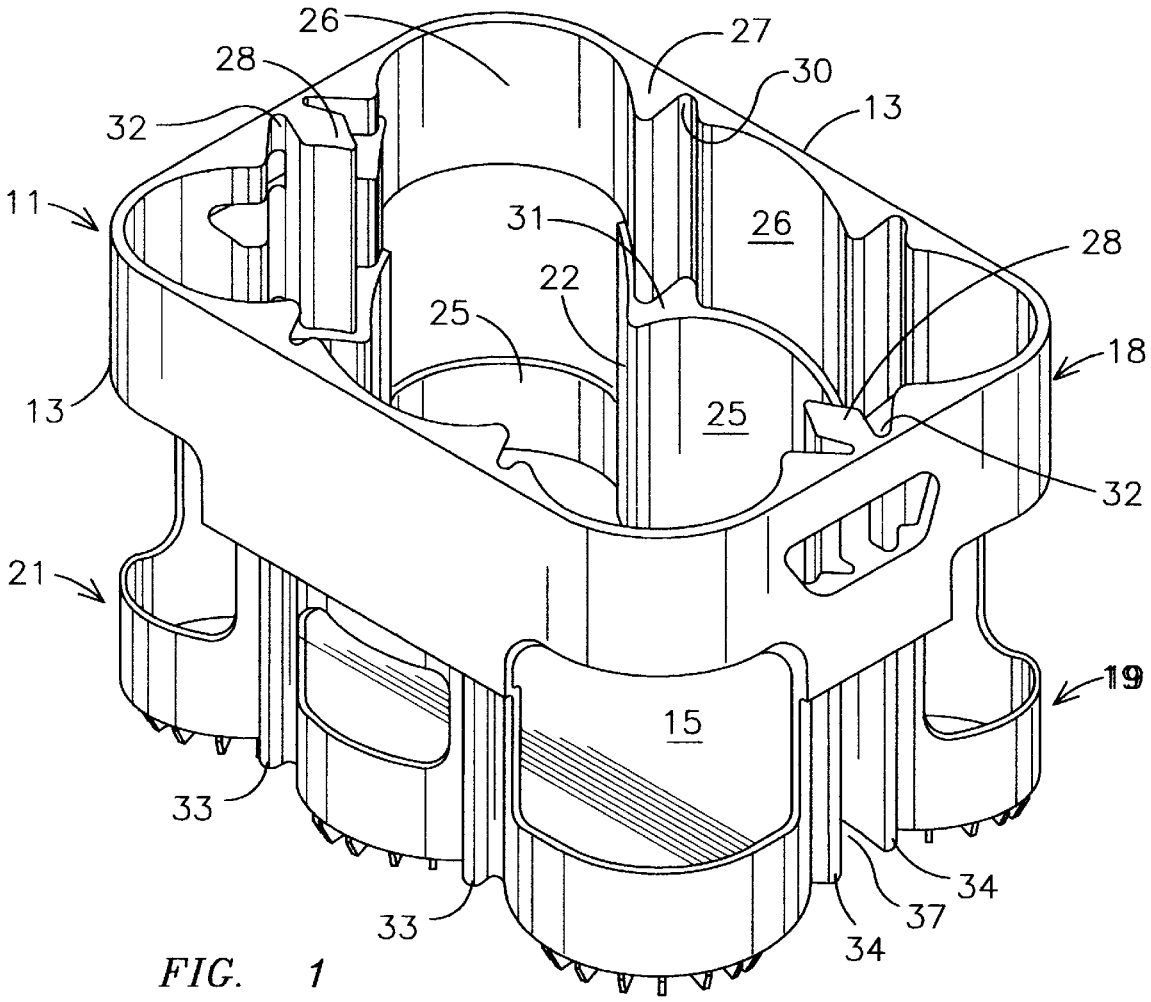
FIG. 1 is a perspective view of the invention.

The crate 11 includes a floor 12 and upright retainer wall 13 (also referred to herein as the "wall") integral the floor 12 and extending along the periphery of the floor 12. The crate floor 12 includes a top 15 and bottom 20. The wall 13 includes opposing end walls 14 and opposing side walls 21. In addition, the wall 13 comprises an upper portion 18 and a lower portion 19. The wall 13 also includes an interior surface and an exterior surface which extendalong the upper wall portion 18 and the lower wall portion 19.

In the embodiment described herein the crate 11 is manufactured using a gas-assist injection mold process. The upper wall portion 18 encases voids or spaces formed between an exterior wall and interior wall. This construction maintains a stable double wall construction while making the crate light enough for handling.

The interior surface along the upper portion 18 of the retainer wall 13 is displaced horizontally from the interior surface of the lower wall portion 19, toward the exterior surface of the wall 13. This displacement of the interior surface creates a nesting step 31. As will be explained in more detail below, the displacement of the interior surface facilitates the nesting effect of empty crates by supporting an upper crate nesting within a second lower empty crate of similar configuration.

Figure 2:
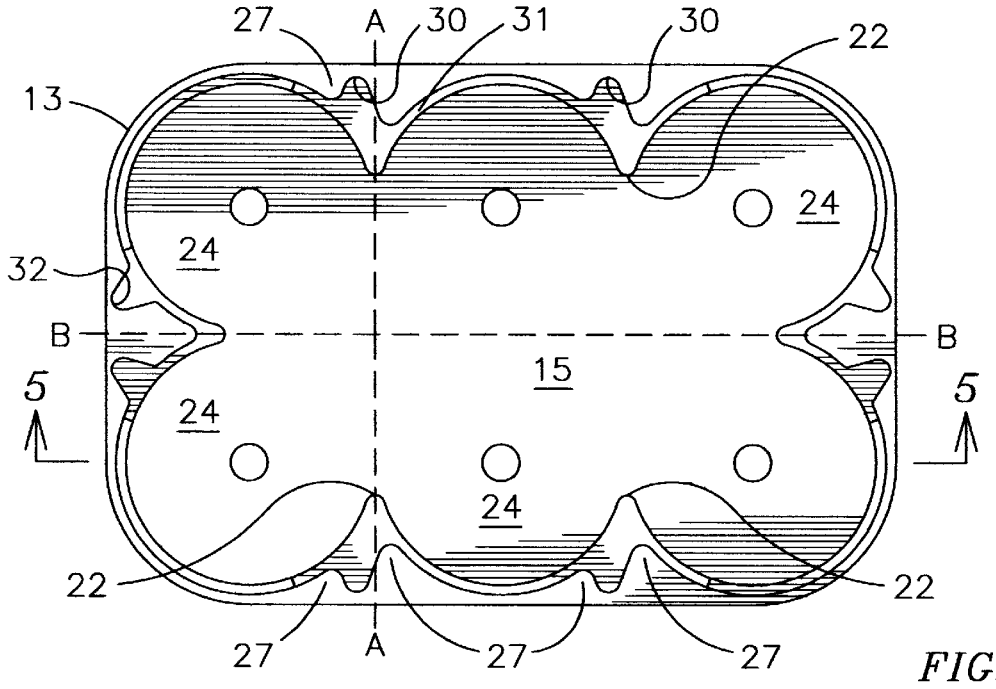
FIG. 2 is a top view of the invention.
Figure 3:
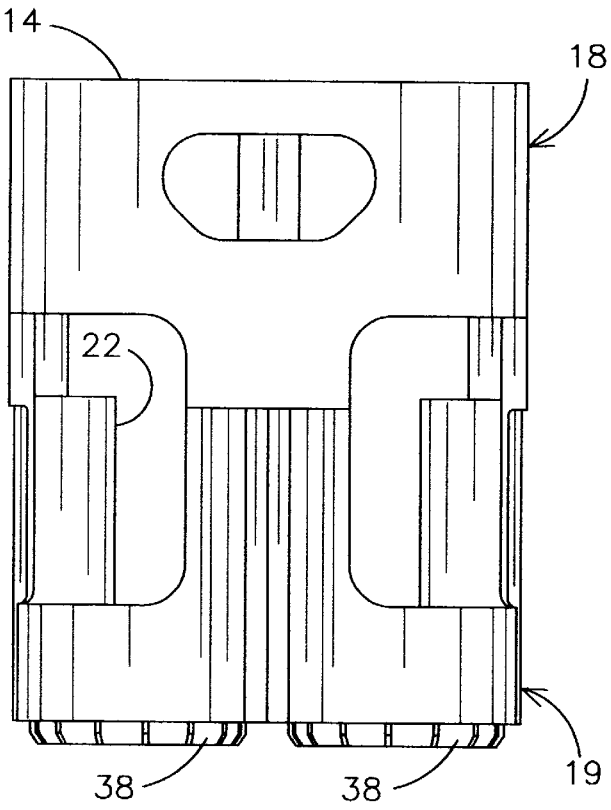
FIG. 3 is an end view of the invention.

As shown in FIGS. 1 and 2, the interior surface of the wall 13 is an undulating surface forming a plurality of pockets 24 within which bottles stand. The lower wall portion 19 includes a plurality of lower arcuate support surfaces 25 (also referred to as "lower support surfaces") forming the interior surface. The upper wall portion 18 also includes a plurality of arcuate support surfaces 26 (also referred to as "upper support surfaces") along the interior surface of the upper wall portion 18. Each upper support surface 26 on the upper wall portion 18 is concentrically aligned above a respective lower support surface 25 on the lower wall portion 19. The lower support surfaces 25 extend from the floor top 15 to a height approximately one-half of the height bottle 40 measured from the bottom of the bottle 40 to the top of the cap 41. The height of the support surface 25 may vary with respect to the height of the bottle 40, but the support surface must be sufficiently tall to support a bottle 40 in an upright position within the crate 11.

The crate 11 includes a plurality of vertically disposed projections, columns and channels along the exterior and interior surfaces to facilitate both the nesting of one crate within another, and the stacking of crates atop one another. In the embodiment described herein, the lower portion 19 of the wall 13 has lower elongated projections 22 (also referred to as "lower projections 22") formed on the side walls 21 and the end walls 14. The lower projections 22 extend vertically from the floor 12 to the nesting step 31.

In the embodiment illustrated herein, each lower projection 22 is integrally connected with the adjacent lower support surfaces 25 forming pockets 24 within which bottles 40 stand. The lower projections 22 along the side walls 21 are spaced equidistance with respect to the end walls 14, and with respect to one another, and the lower projection 22 on each end wall 14 is centrally aligned to form the pockets 24 having equal diameters. As illustrated in the top view in FIG. 2, the lower projections 22 on a sidewall 21 are aligned with the elongated lower projections 22 on the opposing side wall 21.

A channel 30 is formed in the arcuate support surfaces 26 on the upper wall portion 18 above each of the lower projections 22 along the side walls 21. The channel 30 extends from the nesting step 31 to the top of the crate 11 forming a pair of upper projections 27 within the crate 11 above each of the lower projections 22 along the side walls 14 and 15. The upper projections 27 extend vertically from the nesting step 31 to the top of the crate 11.

As may be appreciated in FIG. 2, each of the channels 30 is slightly offset with respect to the lower projection 22 toward the same end wall 14. In FIG.2, a centerline A is drawn across the crate 11 illustrating the alignment of the lower projections 22. Each of the channels 30 is disposed to the left of the centerline A toward the same end wall 14. If the crate is rotated 180° then the channels 30 will be offset to the right of the centerline A. A second centerline B is drawn longitudinally along the crate 11 so the arcuate support surfaces 25 and 26, projections 22, 27 and channels 30 on one side wall 21 are a mirror image of the projections 22, 27 and channels 30 on the opposing side wall 21.

In addition to the channels 30 along the upper wall portion 18 of the side wall 21, channels 32 are also formed in the support surfaces 26 along the end walls 14. The channels 32 extend vertically from the nesting step 31 to the top of the crate 11. An upper end projection 28 extends vertically from the nesting step 31 to the top of the crate 11 intermediate the channels 32 on the end walls 14.

Figure 7:
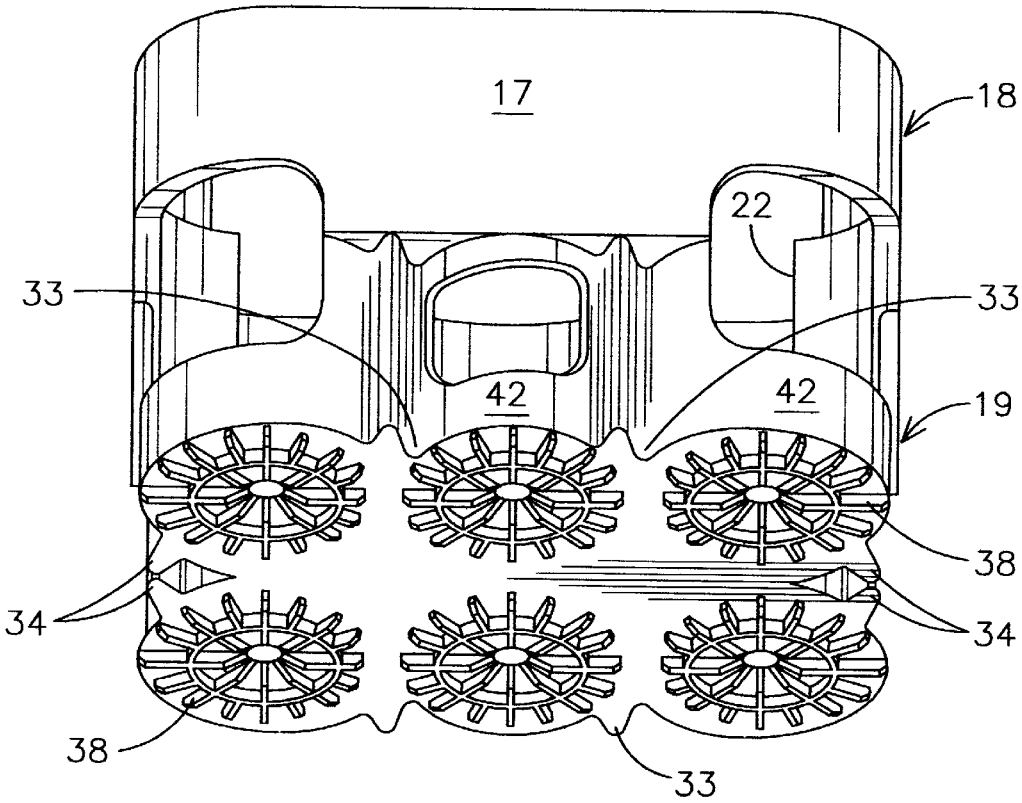
FIG. 7 is a bottom perspective view of the invention.

With respect to FIGS. 1 and 7, exterior columns 33 and 34 are vertically disposed along the exterior surface 17 of the lower wall portion 19 and extend from the bottom of the floor 12 to the upper wall portion 18. The columns include the side columns 33 positioned along the side wall 21 and end columns 34 positioned along the end wall 14. The exterior columns 33 and 34 are located along the lower wall portion 18 of the side walls 21 such that the side columns 33 and end column 34 fit within the channels 30 and 32 respectively along the interior surface of the upper wall portion 18 when a crate is nested within a lower empty crate of a like configuration.

Each side column 33 is positioned below a channel 30 formed on the interior surface of the upper wall portion 18. The side columns 33 are configured for mating relationship with the channel 30 of a lower crate. Each end column 34 is positioned below a channel 32 formed on the interior surface of the upper wall portion 18 on each end wall 14. The end columns 34 are configured for mating relationship with the channels 32 of a lower crate. As will be explained in more detail below, this arrangement of columns and channels facilitates nesting of an upper and lower crate.

The exterior surface consists in part of a plurality of convex surfaces 42 extending along the lower wall portion 19. Each convex surface 42 extends concentrically with a corresponding lower support surface 26 on the lower wall portion 19. Each side column 33 is disposed between adjacent exterior surfaces 42 forming an indentation 35 on each side of the side column 33. The upper projections 27 along the upper wall portion 18 fit within the indentations 35 on another crate when two crates are nesting. In addition, each end column 34 is attached to a convex surface 42 along the end wall 14 forming a vertically extending notch 37. The upper end projection 28 on the upper interior wall portion 18 of a crate 11 fits in mating relationship with the notch 37 on the lower exterior wall portion 19 of another crate 11 when two crates nest.

Figure 4:
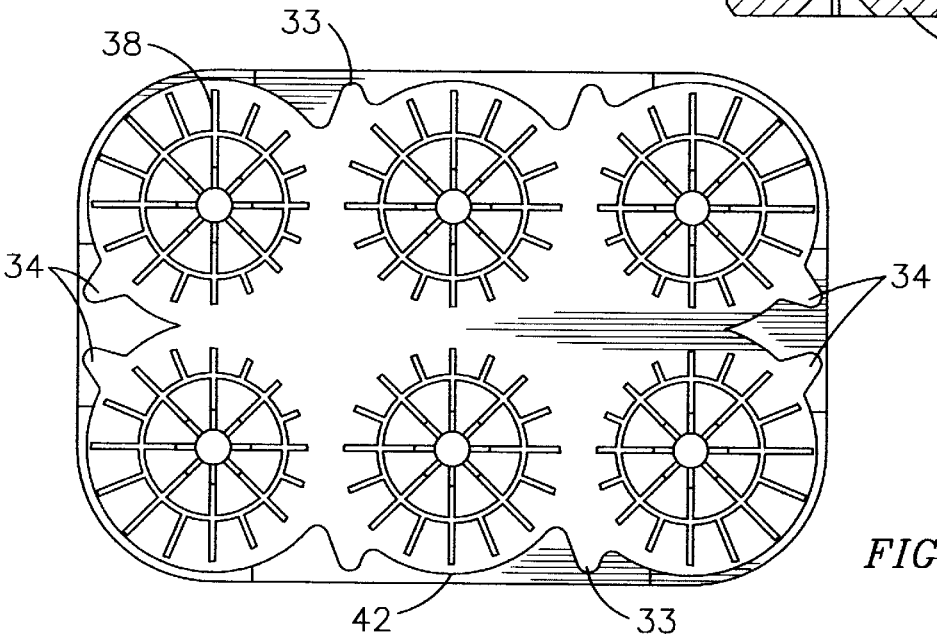
FIG. 4 is a bottom view of the invention.
Figure 6:
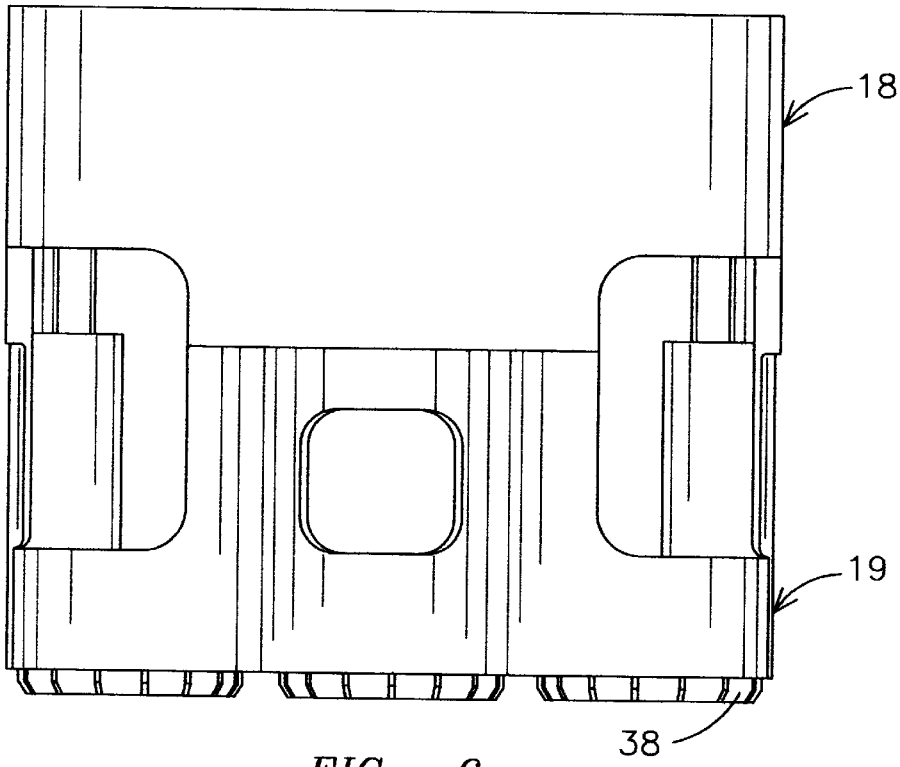
FIG. 6 is a side elevational view of the invention.

With respect to FIGS. 4 and 7, the crate 11 is illustrated having a plurality of stacking rings 38 mounted to, and depending from, bottom 20 of the crate floor 13. The stacking ring 38 includes a plurality of ribs 39 annularly spaced apart below each pocket 24. The stacking rings 38 depends from the crate floor bottom 20, so the stacking rings nest within a lower crate that is empty or filled with bottles, and serves as a locking mechanism when crates are stacked and cross-stacked.

When larger bottles 40 of carbonated liquids are held in a plastic bottle with a cap 41, the cap 41 has a tendency to bulge upward or dome; therefore, it is desirable to avoid contacting the bottle cap 41 and placing undo pressure on the cap 41 which may cause leaking. Accordingly, the stacking ring 38 includes a depression within which a bottle cap 41 may seat. The depression is preferably a conical shape within the stacking ring 38. The depression is centered on a pocket 24. Each of the ribs 39 includes a diagonal edge 42 extending upward toward the crate floor 12 bottom 20 forming the conically shaped depression.

Figure 5:
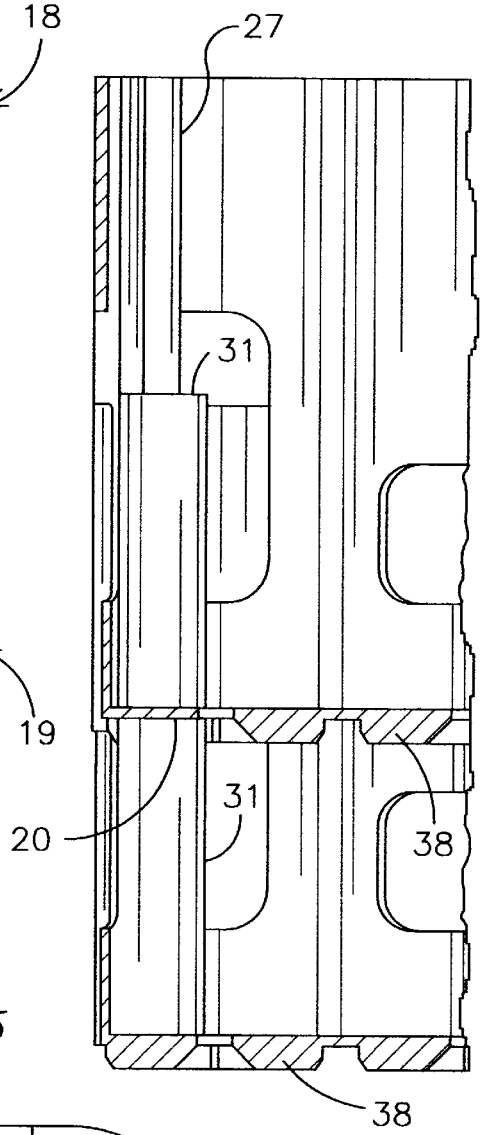
FIG. 5 is a sectional view of the invention taken along line 5—5 in FIG. 2.
Figure 8:
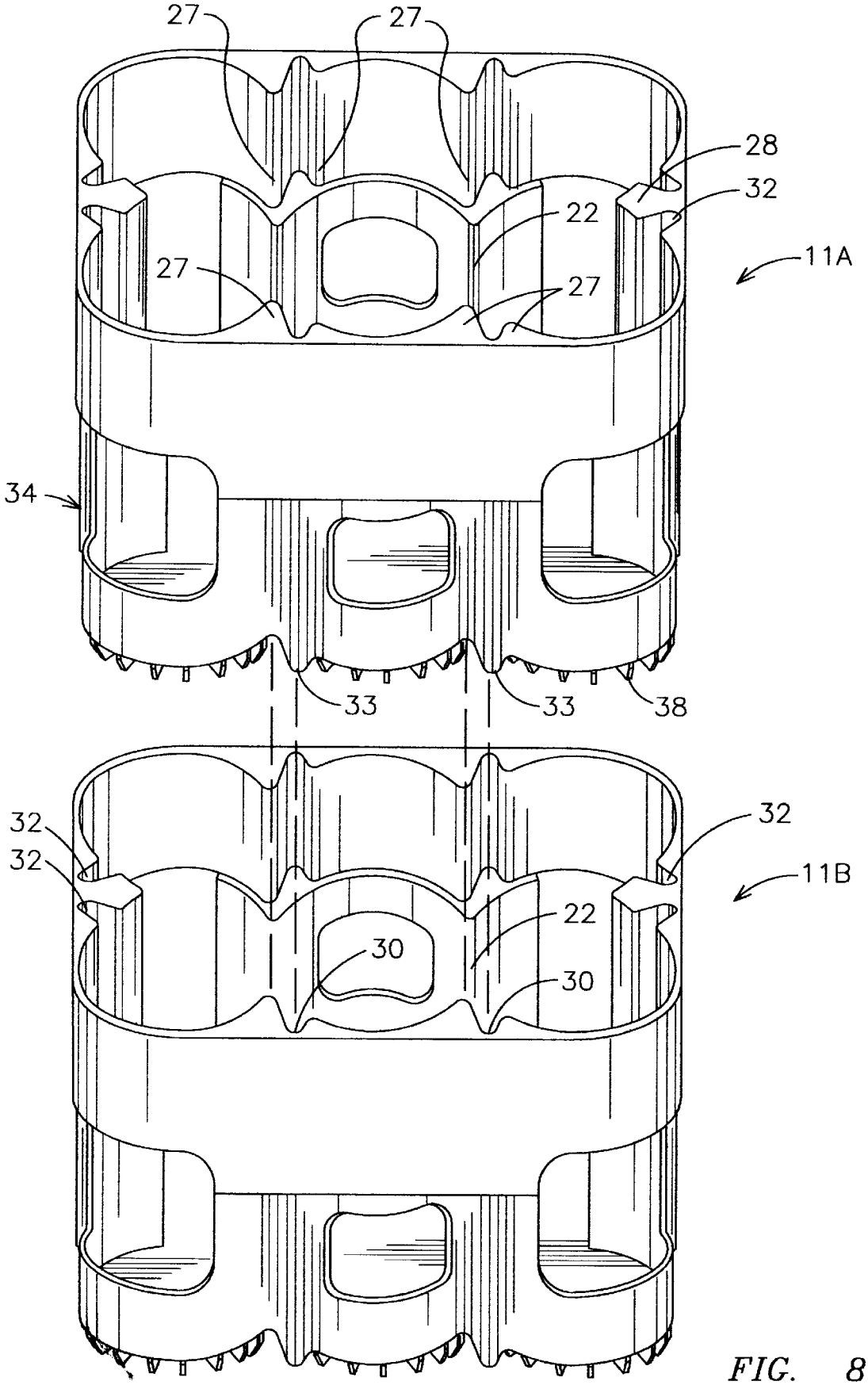
FIG. 8 is a perspective view of two empty crates being stacked for nesting.
Figure 10:
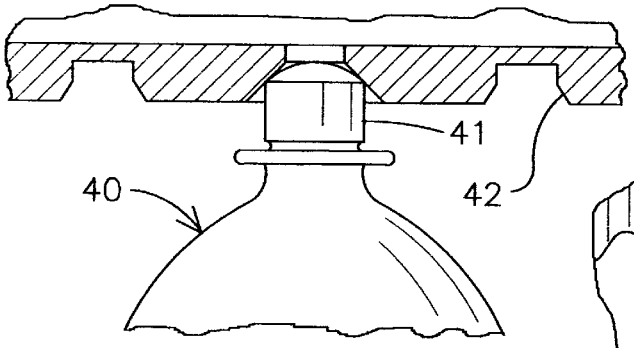
FIG. 10 is a sectional view of the bottom of a crate disposed over a bottle.
Figure 11:
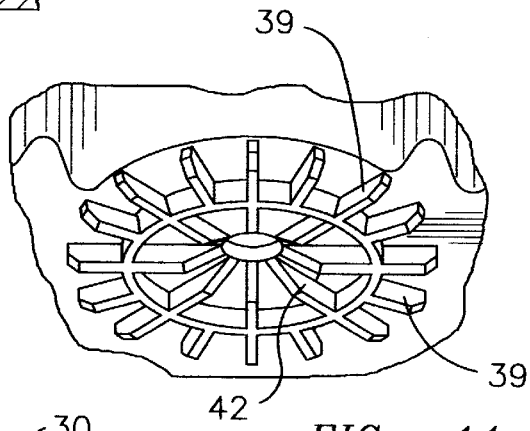
FIG. 11 is a bottom view of a crate illustrating a stacking ring.
Figure 9:
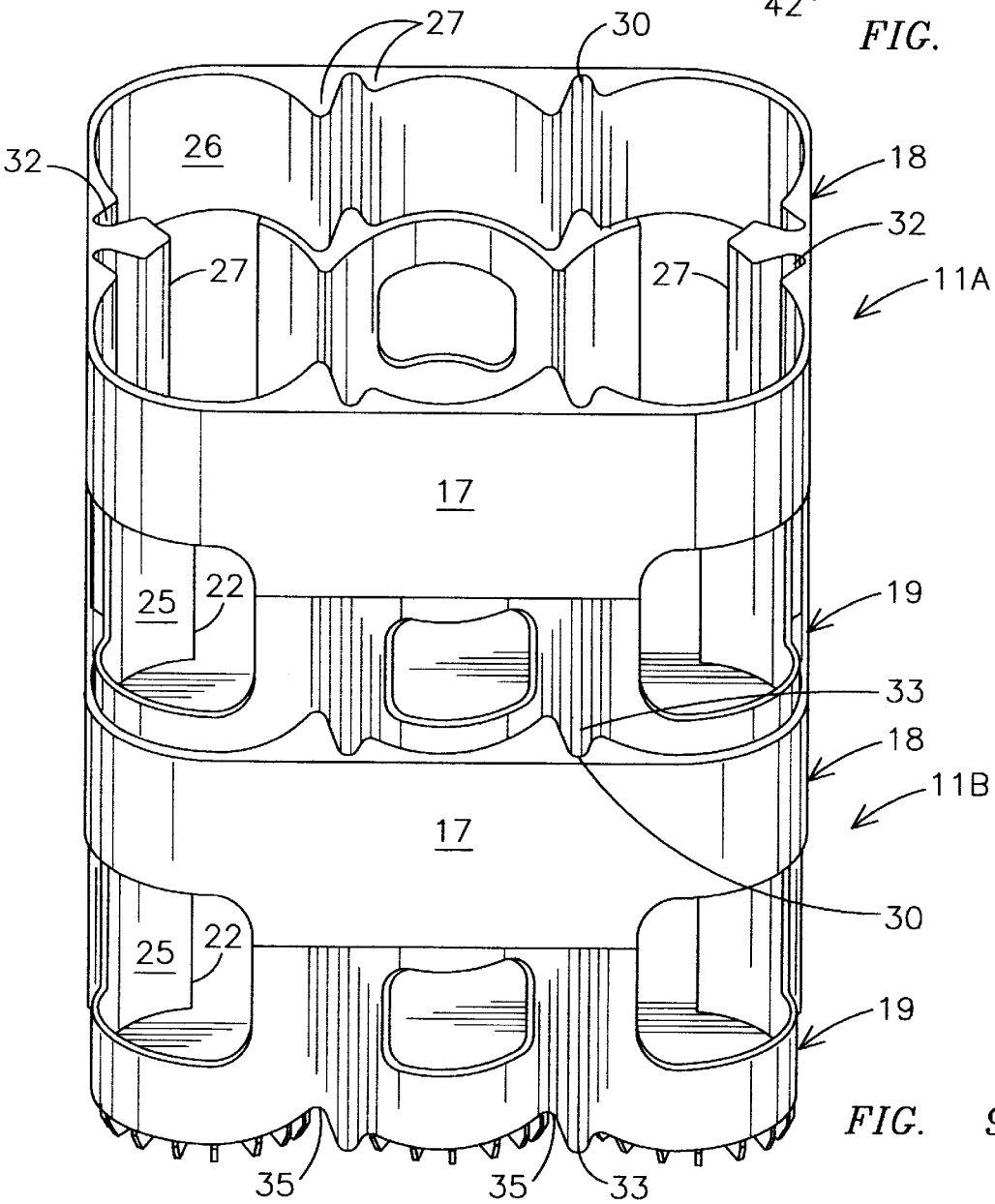
FIG. 9 is a perspective view of an upper crate stacked on top of a lower crate.
Figure 12:
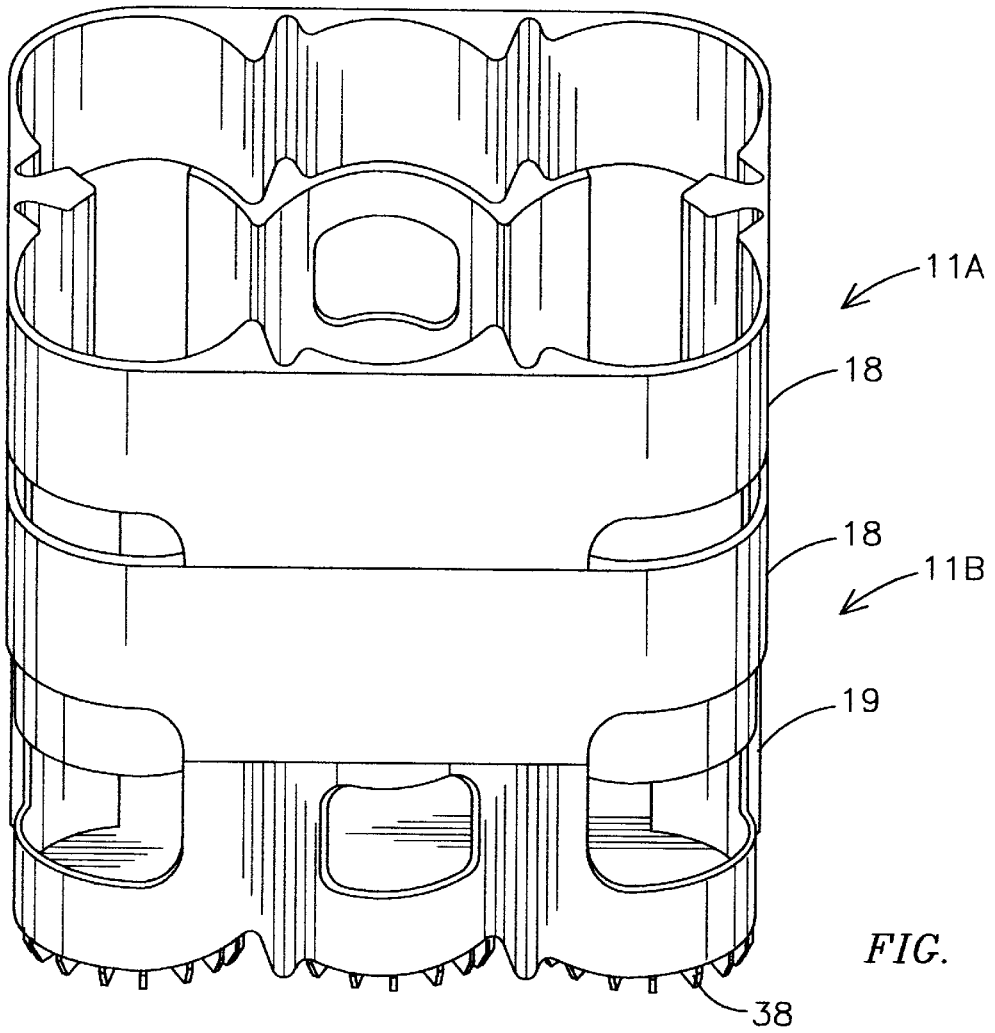
FIG. 12 is a perspective view of an upper crate nesting within a lower crate.
Figure 14:
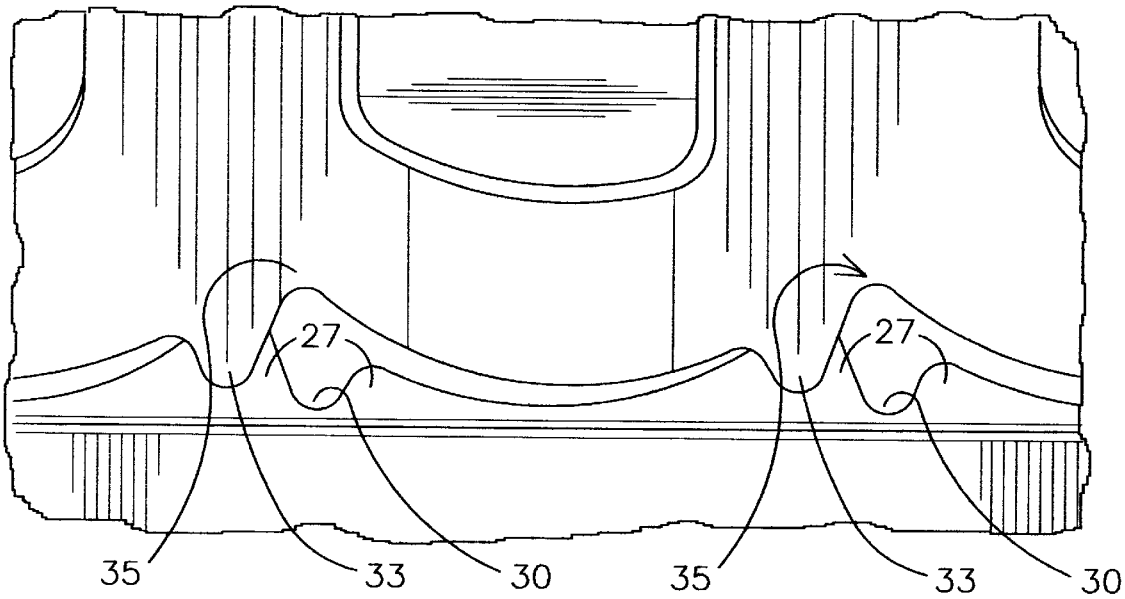
FIG. 14 is an expanded view of an upper crate stacked on top of a lower crate.

With respect to the nesting of the full-depth crate 11, FIGS. 5, 8, and 12 illustrate an upper crate 11A shown nesting within a lower crate 11B. In FIG. 8., the exterior columns 33 on the side wall 21 of an upper crate 11A are aligned with the channels 30 in a lower crate 11B. The interior upper projections 27 on the side wall 21 on the lower crate 11B are aligned with the indentations 35 adjacent the side columns 33. The elongated notch 37 on each end wall 14 of the upper crate 11A is aligned with the end column 28 on the upper wall portion 18 of the lower crate 11B.

The FIG. 5 illustrates a cross-sectional view of the top crate 11A nesting within a bottom crate 11B. The nesting step 31 supports a crate 11A nesting within the bottom crate 11B. The crate floor bottom 20 rests on the nesting step 31. The stacking ring 38 nests within a corresponding pocket 24 in the bottom crate 11. The crate 11 is preferably fifty percent nestable. The lower wall portion 19 is about one-half the total height of the wall 13 measured from the crate floor top 15 to the nesting step 31. The lower wall portion 19 nests within the upper wall portion 18 of a lower crate so the crates nest up to fifty percent of the height of the crate 11 measured from the top 15 of the crate floor 12.

Figure 13:
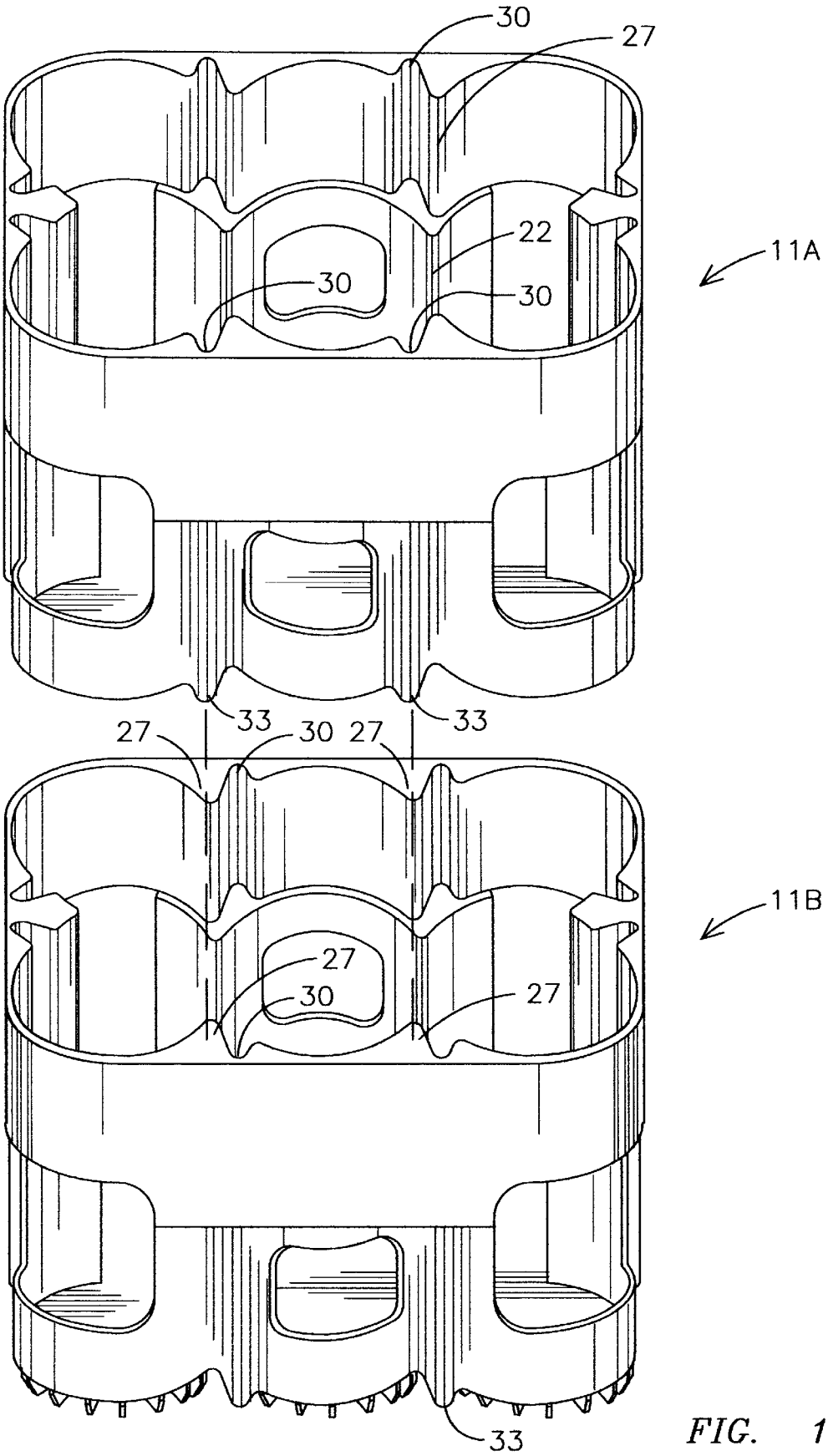
FIG. 13 is a perspective view of an upper crate to be stacked on a lower crate.
Figure 15:
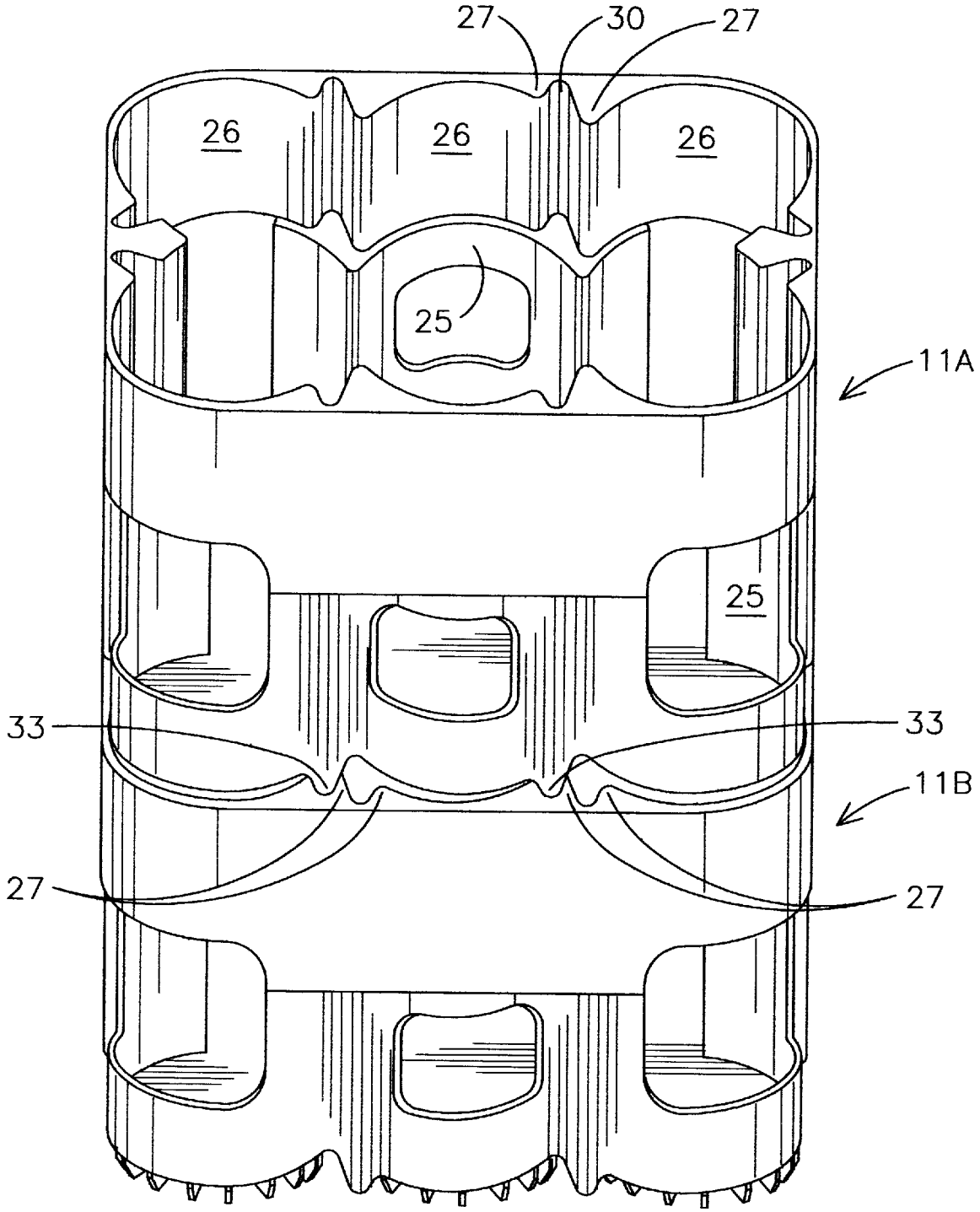
FIG. 15 is a perspective view of an upper crate stacked on top of a lower crate.

As previously noted, the crate 11 is also stackable when storing or transporting crates with our without bottles. In FIGS. 13 and 15, the top crate 11A has been rotated 180° with respect to the bottom crate 11B and stacked atop the bottom crate 11B. The channels 30 in the interior surface of the side wall 21 upper portion 18 is displaced above the projection 22 toward the same end wall 14 with respect to the projections. When the crate 11A is rotated, the side columns 33 are no longer aligned with the channels 30. As shown in FIGS. 13 and 15, the side columns 33 contact the upper projections 27. The upper projections 27 support the top crate 11A in a stacked position. The stacking rings 38 depend from the bottom 20 of the crate floor 12 and extend within the lower crate 11B, locking the top crate 11A in place with the bottom crate 11B.

Figure 16:
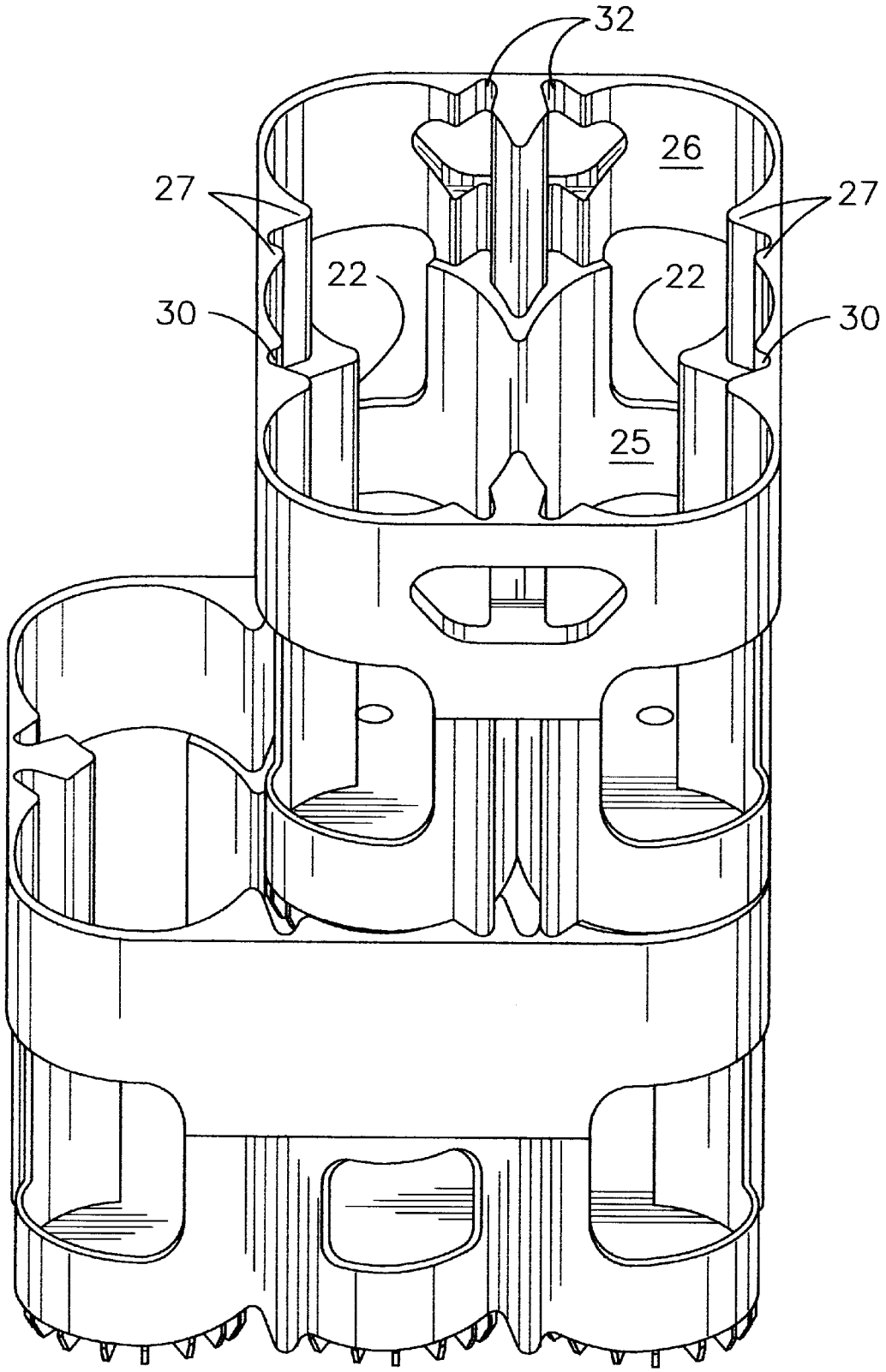
FIG. 16 is a perspective view of an upper crate cross-stacked on top of a lower crate.
Figure 17:
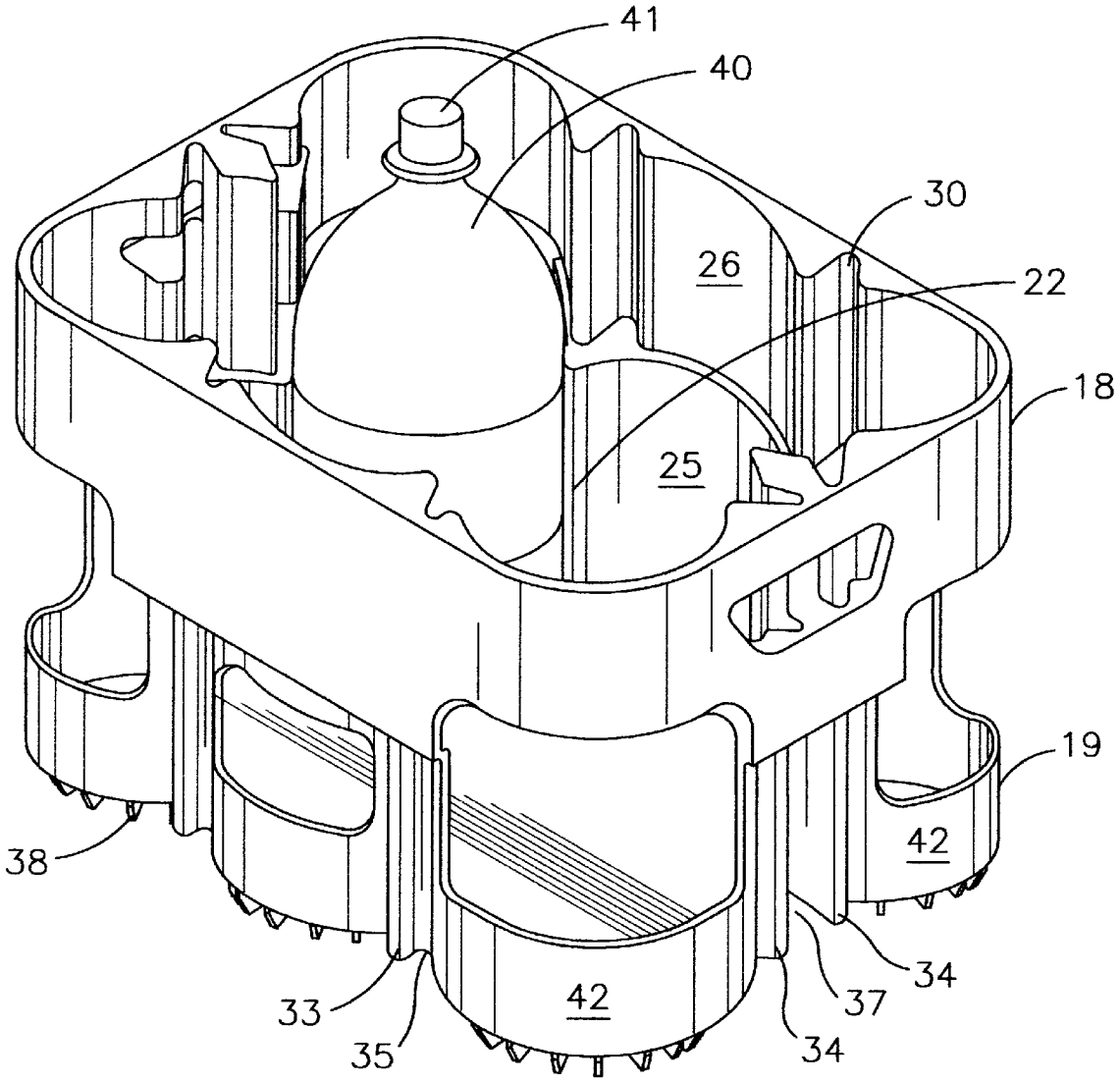
FIG. 17 is a perspective view of the inventive crate with a bottle.

In FIG. 16 top crate 11 A is placed at a right angle with respect to the bottom crate 11B. Each of the crates 11A and 11B includes six pockets 24. Four of the pockets 24 in the top crate 11A stack over pockets 24 over the bottom crate 11B with the stacking rings 38 extending into the bottom crate 11B. Two of the pockets 24 toward end 14 of the top crate 11A hang over and stack upon a second lower crate (not shown). As the stacking rings 38 extend into bottom crates 11B in this cross-stacking arrangement, the stacking rings 38 on the top crates 11A lock the bottom crates 11B together forming tiers of crates interlocking crates of a single layer and consecutive layers.

While we have disclosed the preferred embodiment of our invention, it is not intended that this description in any way limits the invention, but rather this invention should be limited only by a reasonable interpretation of the new recited claims.

What is claimed is:

1. A full-depth nestable crate with a second crate of a like configuration, comprising:

(a) a floor having a top and bottom;

(b) a wall attached to the floor extending along the periphery thereof, said wall having an interior wall surface and an exterior wall surface and said wall having an upper wall portion and a lower wall portion; and, (c) said interior surface along the upper wall portion is displaced, with respect to said interior wall surface along the lower wall portion, toward the exterior wall surface of the crate forming a substantially horizontally disposed nesting step between the interior surface of the upper wall portion and the lower wall portion, whereby a lower portion of said crate is nestable within the upper portion of said second crate wall and the bottom of said floor of said crate is supported on a nesting step in the second crate, whereby said crate is nestable within the second crate up to one-half of the height of said crate.

2. A full-depth nestable crate as defined in claim 1 wherein said wall includes a first side wall, a second side wall, a first end wall and a second end wall, and a plurality of channels formed in the interior surface of the upper portion of the wall extending from the nesting step vertically to a top of the crate, and said crate also includes a plurality of columns on the exterior surface of the lower portion of the wall, each said exterior column is disposed below a respective channel along the interior surface of the upper wall portion, each said column extending from the floor bottom to the upper portion of the wall, and said columns are formed for mating relationship with the channels in the second crate for nesting said crate within said second crate in a first position, whereby said columns on said crate engage a nesting step on the second crate and support said crate on said second crate, and said crate is stackable on the second crate in a second position rotated 180°, about a vertical axis, with respect to said first position of the crate, whereby the columns engage a top surface of the wall adjacent said columns.

3. A full-depth nestable crate as defined in claim 2 wherein said crate further includes a plurality of projections disposed within said crate spaced apart along the lower portion of the crate wall and extending upward from the top of the floor to the nesting step, and each said projection is positioned below a channel in the upper portion of the wall, and each said channel along the upper portion of the wall is disposed toward the first end wall with respect to said projections.

4. A full-depth nestable crate as defined in claim 3 further including means, depending, from the bottom of the floor, for locking said crate with a second crate when said crates are stacked or nested atop one another.

5. A full-depth nestable crate as defined in claim 4 wherein said locking means includes a plurality of stacking rings depending from the bottom of the floor, and each said stacking ring is disposed below a pocket, and each said stacking ring having a depression for seating a bottle cap of a bottle therein.

6. A full-depth nestable crate, comprising:

(a) a floor having a top and bottom;

(b) a wall attached to the floor extending along the periphery thereof, said wall having an interior wall surface and an exterior wall surface and said wall having an upper wall portion and a lower wall portion;

(c) said interior surface along the upper wall portion is displaced, with respect to said interior wall surface along the lower wall portion, toward the exterior wall surface of the crate forming a nesting step between the interior surface of the upper wall portion and the lower wall portion, whereby a lower portion of said crate is nestable within the upper portion of a second crate wall and the bottom of said floor of said crate is supported on a nesting step in the second crate, whereby said lower portion of the crate is nestable within the upper wall portion of a second crate up to one-half of the height of said crate;

(d) said interior surface having a plurality of arcuate shaped support surfaces along the lower portion of the wall forming a plurality of pockets within which a bottle may stand; and (e) said interior surface having a plurality of arcuate shaped upper support surfaces along the upper portion of the retainer wall wherein each said upper support surface is concentrically aligned above a lower support surface.

7. A full-depth nestable crate as defined in claim 6 further including a first side wall, a second side wall, a first end wall and a second end wall, and a plurality of channels formed along the interior surface of the upper portion of the retainer wall extending from the nesting step vertically to a top of the crate, and said crate also includes a plurality of columns integrally formed on exterior surface of the lower portion of each side wall and each end wall below each channel, said column extending from the floor bottom to the upper portion of the retainer wall, and said columns are formed for mating relationship with channels in the second crate for nesting said crate within said second crate in a first position and said crate is stackable on the second crate in a second position rotated 180° with respect to the first position.

8. A full-depth nestable crate as defined in claim 7 wherein said crate further includes a plurality of projections disposed within said crate spaced apart along the lower portion of the crate wall and extending upward from the top of the floor to the nesting step, and each said projection is disposed between consecutive lower support surfaces and integral therewith, and each said projection is positioned below a channel in the upper portion of the wall, and each said channel along the upper portion of the wall is disposed toward the first end wall with respect to said projections.

9. A full-depth nestable crate as defined in claim 6 wherein said crate wall includes two side walls and two end walls and a pair of channels on the interior surface of the first side wall and two channels on the interior surface of the upper portion of the second side wall, and a first rib and a second rib adjacent each said channel, and a column on the exterior surface of lower side wall portion below each channel, and said crate further having a column on the exterior surface of the lower portion of the retainer wall below each said channel on the side wall and formed for mating relationship with channels in a second crate when nested, said crate further having a pair of channels formed in each end wall and a pair of columns formed on the exterior surface of lower end wall portion said columns formed in mating relationship with said end channels of a second crate when the crate is nested within a second crate.

10. A full-depth nestable crate as defined in claim 9 wherein said crate further includes a plurality of projections disposed within said crate spaced apart along the lower portion of the crate wall and extending upward from the top of the floor to the nesting step, and each said projection is positioned below a channel in the upper portion of the wall, and each said channel along the upper portion of the wall is disposed toward the first end wall with respect to said projections.

* * * * *